US005678731A

United States Patent [19]

Okamura et al.

[11] Patent Number: 5,678,731

[45] Date of Patent: Oct. 21, 1997

[54] DISCHARGE CONTAINER WITH NOZZLE

[75] Inventors: Naomi Okamura, Kuki; Akio Nimura, Kawaguchi; Masayuki Fukai, Chofu; Chiaki Hata, Ibaraki; Yoshio Nagahama, Higashidemachi; Keizi Shimizu, Osaka, all of Japan

[73] Assignees: Taoka Chemical Company, Limited, Osaka; Cemedine Company, Limited, Tokyo, both of Japan

[21] Appl. No.: 519,136

[22] Filed: Aug. 24, 1995

[30] Foreign Application Priority Data

Aug. 24, 1994 [JP] Japan ..... 6-224264

[51] Int. Cl.[6] ..... B65D 35/56

[52] U.S. Cl. ..... 222/105; 222/183; 222/391

[58] Field of Search ..... 222/95, 105, 183, 222/212, 386.5, 391, 567, 568

[56] References Cited

U.S. PATENT DOCUMENTS

| | | | |
|---|---|---|---|
| 3,161,326 | 12/1964 | Parr | 222/105 X |
| 4,702,398 | 10/1987 | Seager | 222/105 X |
| 5,301,835 | 4/1994 | Fulks et al. | 222/105 X |
| 5,322,194 | 6/1994 | Roberts | 222/105 X |
| 5,373,967 | 12/1994 | Grooms et al. | 222/95 |
| 5,429,254 | 7/1995 | Christine | 222/105 X |

FOREIGN PATENT DOCUMENTS

| | | |
|---|---|---|
| 4198963 | 7/1992 | Japan . |
| 6191545 | 7/1994 | Japan . |
| 741022 | 2/1995 | Japan . |

*Primary Examiner*—Joseph Kaufman

*Attorney, Agent, or Firm*—Birch, Stewart, Kolasch, Birch, LLP

[57] ABSTRACT

The present invention relates to an improvement of a discharge container with a nozzle for housing a liquid, for example, an instantaneous adhesive or another moisture curing type adhesive, various adhesives such as solvent volatilizing type adhesive, various chemicals, foods, inks and medical supplies. The present invention is a discharge container with a nozzle which includes a container body for housing contents, a nozzle threadly attached to the container body, and a dual-shoulder type protective frame having a neck hole, wherein the base end of the mouth of the container body is inserted through the neck hole of the dual-shoulder type protective frame, and the container body is threadly attached to the nozzle, thereby allowing them to be made a one-piece structure. The present invention is a highly safe and easy-to-use container which can house a relatively high viscosity liquid such as jelly-like and grease-like ones, be stood up, discharge the contents smoothly until before the last service, provide no liquid run and leakage, and discharge the contents completely until before the last service. Particularly, the container of the present invention is excellent in safety and operability such that the container is opened or closed through the protective frame without directly touching the container body, so that the tube when used is not deformed or broken until before the last service.

18 Claims, 15 Drawing Sheets

Fig. 3-a
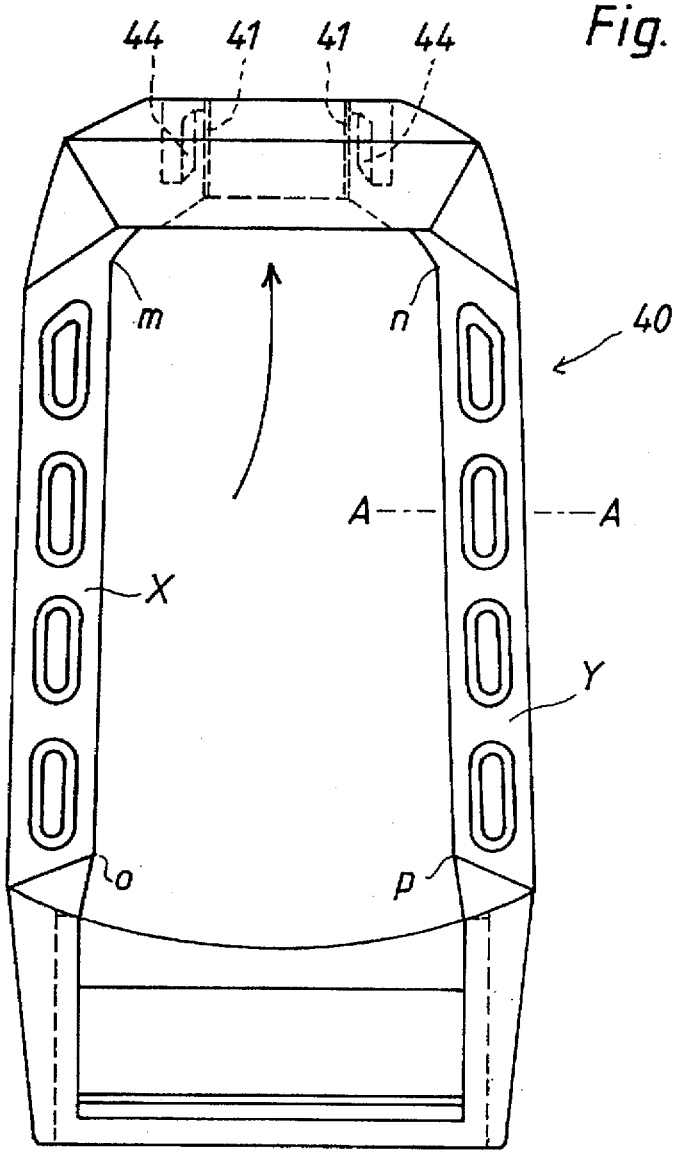
Fig. 3-b
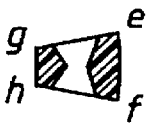
Fig. 3-c
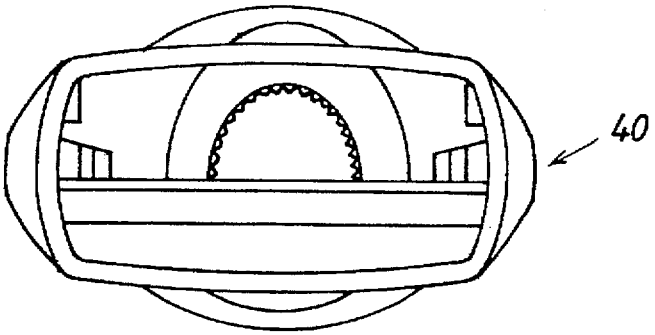

Fig. 4-a
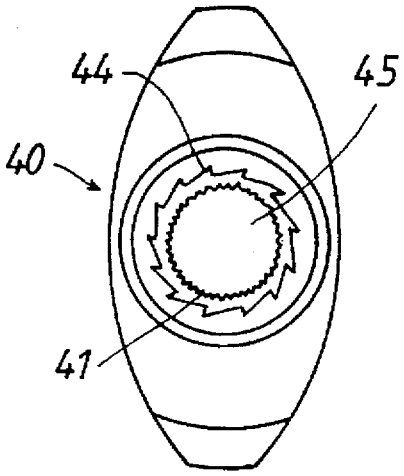
Fig. 4-c
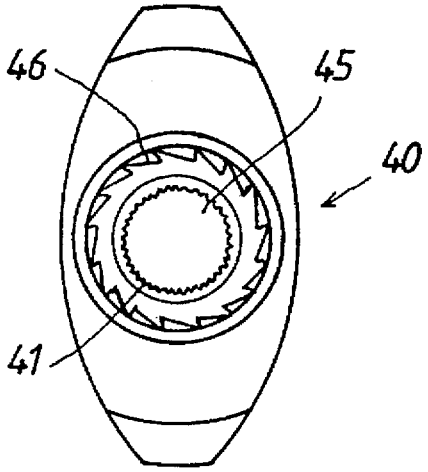
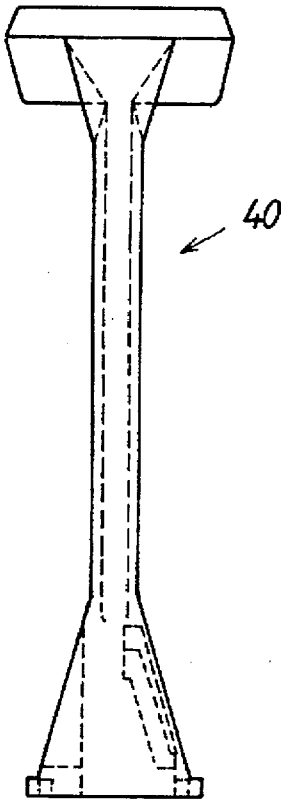
Fig. 4-b

Fig. 6-a
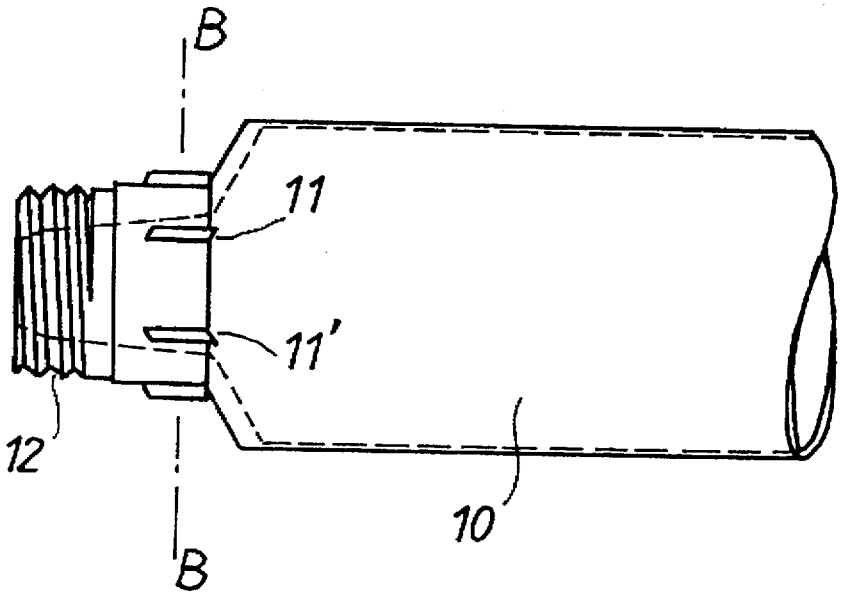
Fig. 6-b
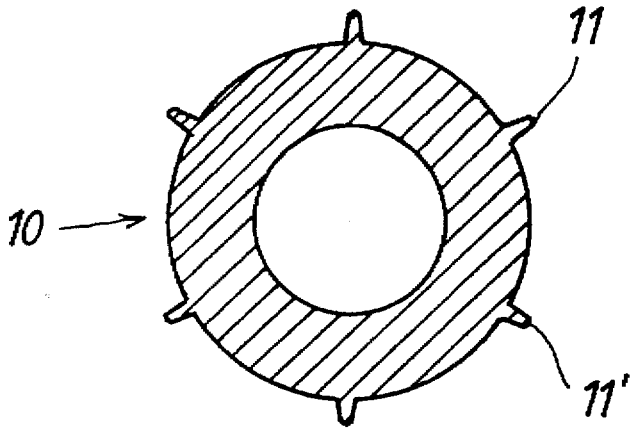

Fig. 7-a
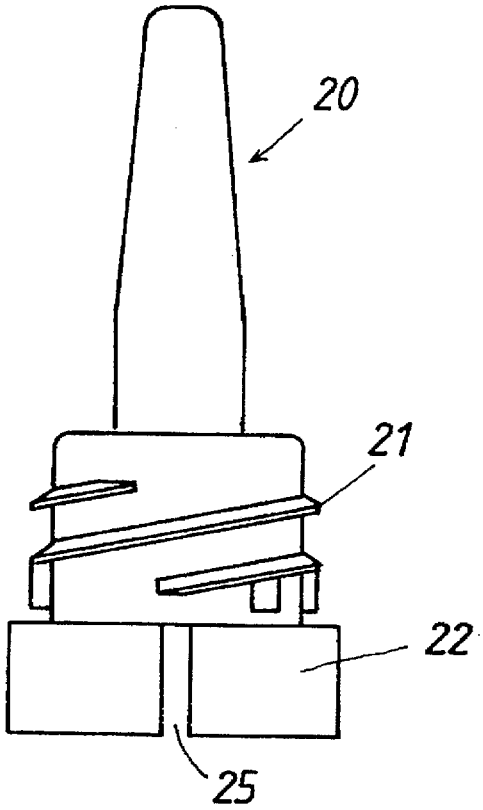
Fig. 7-b
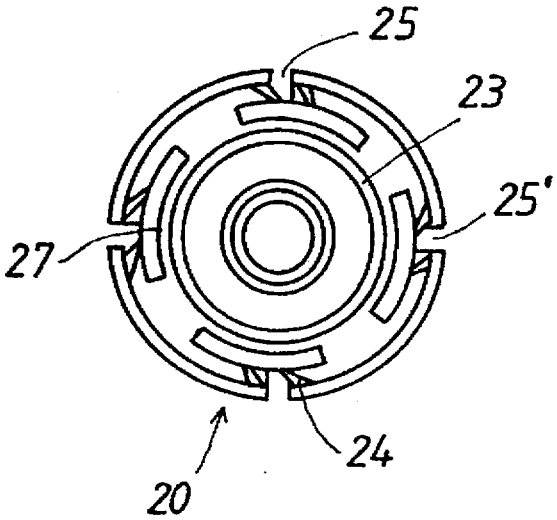

Fig. 8-a
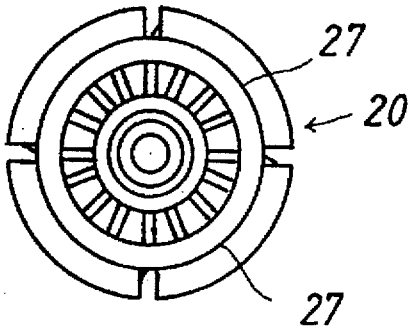
Fig. 8-b
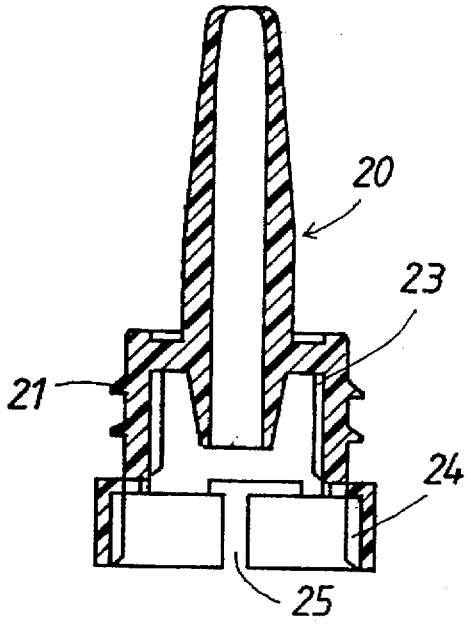
Fig. 8-c
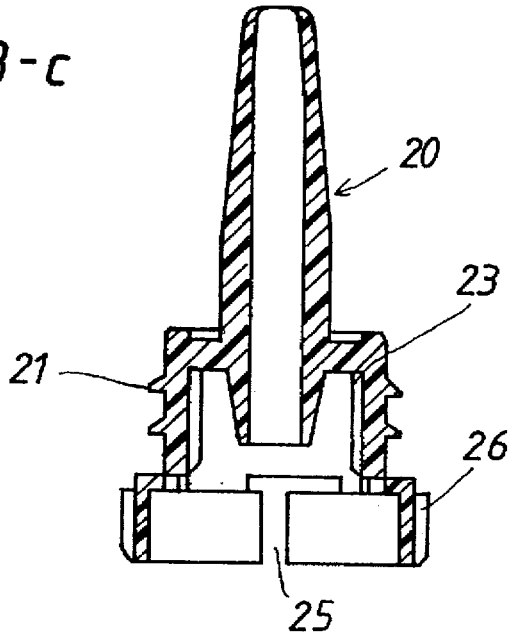

Fig. 9-a
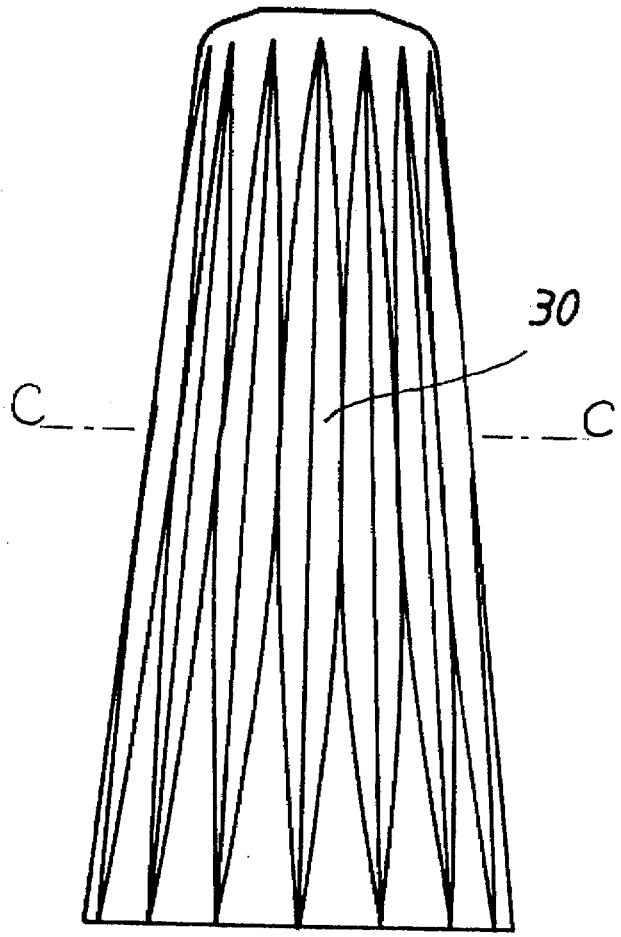
Fig. 9-b
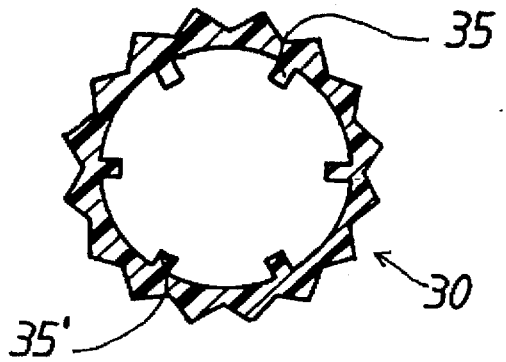

Fig. 10-a
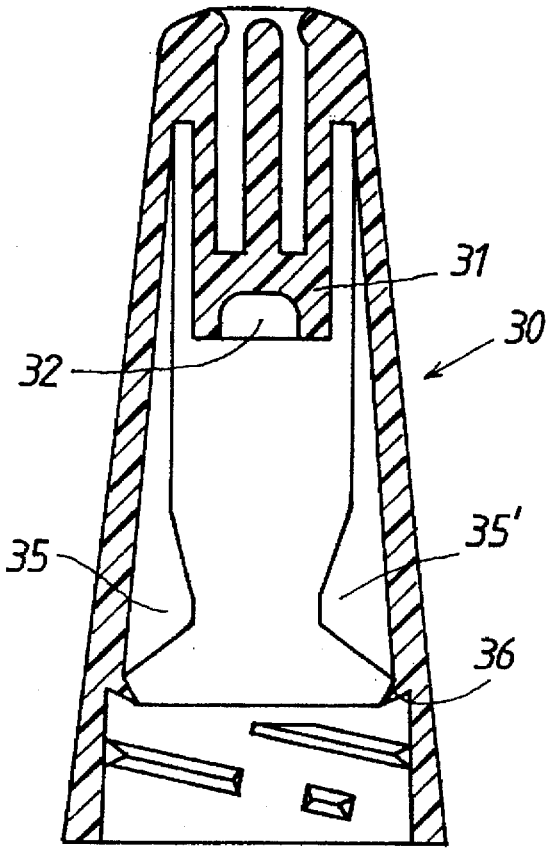
Fig. 10-b
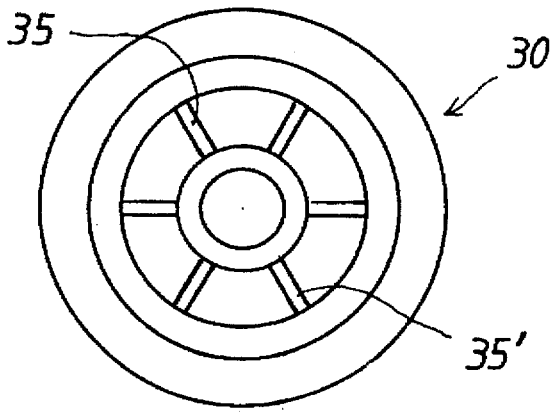

Fig. 11-a
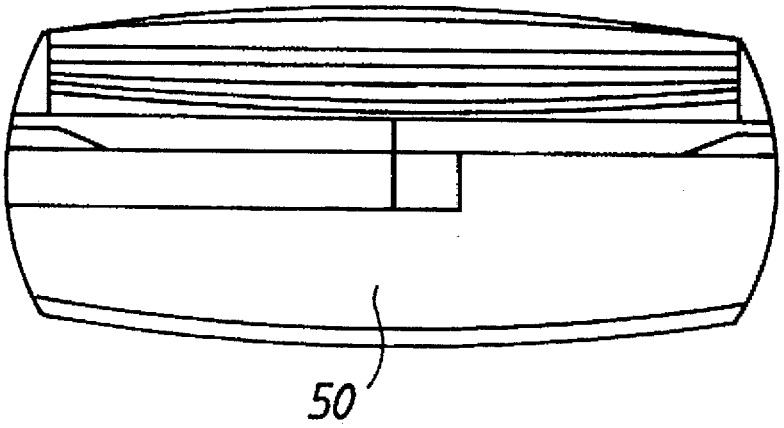
Fig. 11-b
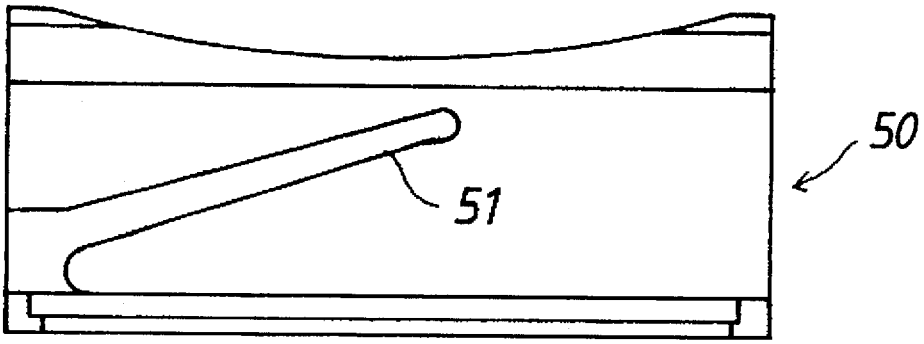

Fig. 12-a
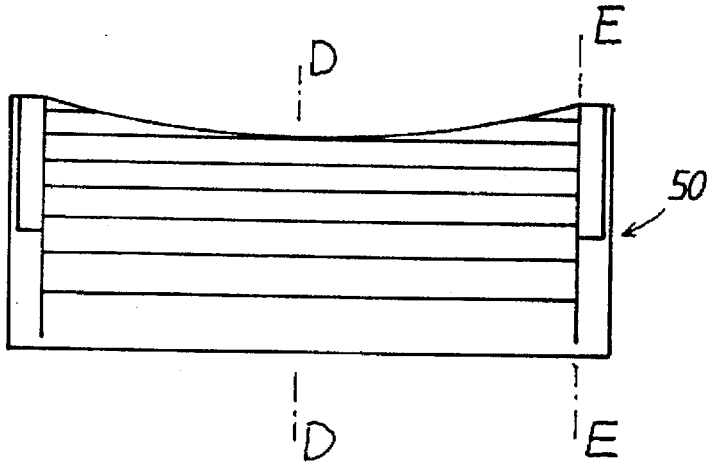
Fig. 12-b
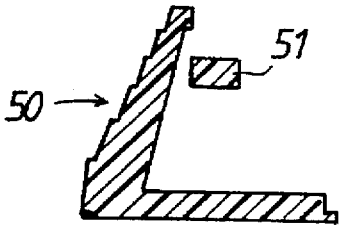
Fig. 12-c
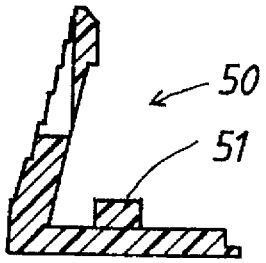
Fig. 12-d
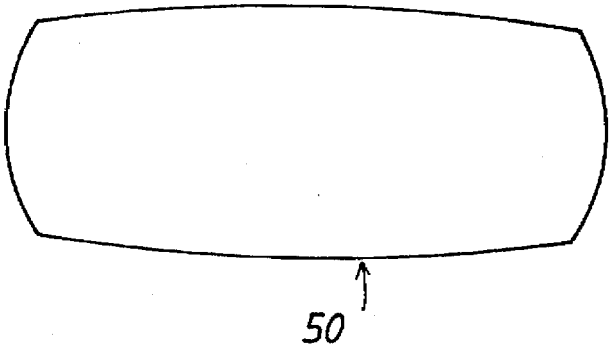

DISCHARGE CONTAINER WITH NOZZLE

BACKGROUND OF THE INVENTION

The present invention relates to an improvement of a discharge container with a nozzle for housing a liquid, for example, an instantaneous adhesive such as α-cyanoacrylate based adhesive or other moisture curing type adhesive, various adhesives such as solvent volatilizing type adhesive, various chemicals, foods, inks and medical supplies.

A liquid adhesive includes those of different types such as solvent volatilizing and moisture curing, of which the solvent volatilizing type adhesive cannot employ a plastic tube, and the moisture curing type adhesive also cannot employ a plastic tube through which moisture passes. For these reasons, these type adhesives have employed a metallic tube such as an aluminum tube and a lead tube.

Such a metallic tube is deformed and becomes poor in appearance with service, and particularly, the metallic tube cannot be stood up, so that each time the tube when not used is allowed to rest, its cap must be mounted to prevent contents from flowing out. In addition, there also exist problems that where the amount of contents is small, the metallic tube is small, so that it is difficult to handle, and that the metallic tube is difficult to use such that when its cap is opened or closed, for example, at the final step of service, an excessive force might be applied to the cap to cause the tube to be deformed or broken.

In order to solve these problems, the present inventors previously invented a composite container, as the one for a low-viscosity liquid, which comprises a body for housing contents, an internal container with a mouth for discharging the contents from the body, and an outer casing for covering the body of the internal container, and in which a pressure medium is interposed between the internal container and the outer casing (Japanese Patent Application No. HEI 4-198963).

Also, the present inventors previously invented a composite container employing a ratchet gear mechanism which prevents the cap from being strongly and threadly tightened with a force highter than a certain value, and the nozzle from being turned together with the cap when threadly untightened (Japanese Patent application No. HEI 4-348251).

Further, the present inventors invented a container with a nozzle and a cap, which container includes a nozzle connected to a container body for housing contents and a cap for closing the discharge mouth of the nozzle, as an improvement of a nozzle and a cap, and in which container the head of the cap is provided with an inwardly projected cylindrical member for closing the nozzle, and the head of the cylindrical member is provided with a concave hole into which or from which the tip of the nozzle is insertable or disengagable (Japanese Patent Application No. HEI 5-202811).

These prior inventions allow a liquid run to be positively prevented, the contents to be discharged completely, the container to be stood up, and the problem that a conventional container is difficult to use because of excessive tightening of cap, liquid leakage and the like to be solved.

However, these prior inventions have showed that they are preferably applied to contents of a relatively low viscosity liquid, and that for a liquid with a relatively high viscosity such as a highly thixotropic liquid, the so-called jelly-like liquid, particularly when the contents become less, an air layer is formed in the container body, whereby it becomes difficult to discharge the contents.

SUMMARY OF THE INVENTION

Research and study have been wholeheartedly made to develop a highly safe and easy-to-use container which can house a relatively high viscosity liquid such as jelly-like and grease-like ones, be stood up, discharge the contents completely, and provide no liquid run and leakage, and in which the tube when used is not deformed or broken, with the result that the present invention is finally obtained.

The present invention is a discharge container with a nozzle which comprises a container body for housing contents, a nozzle threadly attached to the container body, and a dual-shoulder type protective frame having a neck hole, and is characterized in that the base end of the mouth of the container body is inserted through the neck hole of the dual-shoulder type protective frame, and the container body is threadly attached to the nozzle, thereby allowing them to be made a one-piece structure.

An object of the present invention is to provide a highly safe and easy-to-use container which can be stood up, and provide no liquid run and leakage by interposing a dual-shoulder type protective frame having a neck hole between a container body and a nozzle when threadly attached to each other, by threadly attaching a cap to the nozzle as required, or by providing a bottom member for covering the container body to the dual-shoulder type protective frame.

Another invention of the present invention is a discharge container with a nozzle characterized in that in the above-mentioned container, one or more notch grooves or ribs are provided on the inner peripheral surface of the dual-shoulder type protective frame, while one or more ribs engaging with the above-mentioned notch grooves, or one or more notch grooves engaging with the above-mentioned ribs are provided on the base end of the mouth of the container body, thereby providing a structure for preventing a relative rotation of the container body to the dual-shoulder type protective frame.

Still another invention of the present invention is a discharge container with a nozzle and a cap characterized in that in the above-mentioned container, a boss having an outer ratchet gear corresponding to an inner ratchet gear formed on the inner periphery at the lower end of the above-mentioned nozzle is provided on the outer peripheral surface of the neck hole of the dual-shoulder type protective frame, or a boss having an inner ratchet gear corresponding to an outer ratchet gear formed on the outer periphery at the lower end of the above-mentioned nozzle is provided on the inner peripheral surface outside the neck hole of the dual-shoulder type protective frame, and that the container has a mechanism capable of preventing the cap from being strongly and threadly tightened with a force highter than a certain value, and the nozzle from being turned together with the cap when threadly untightened.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 3*a*–3*c* are a front view, a section view and a bottom plan view, respectively, of a dual-shoulder type protective frame with a neck hole.

FIGS. 4*a*–4*c* represent plan views and a side view of a dual-shoulder type protective frame with a neck hole.

FIGS. 6*a* and 6*b* are illustrative views of a container body.

FIGS. 7*a* and 7*b* are a plan view and a bottom plan view of a nozzle.

FIGS. 8*a*–8*c* are a plan view and section views of a nozzle.

FIGS. 9*a* and 9*b* are a front view and a section view taken on line C—C.

FIGS. 10*a* and 10*b* are a section view and a bottom plan view of a cap.

FIGS. 11*a* and 11*b* are a plan view and a front view of a bottom member.

FIGS. 12*a*–12*d* are a front view, section views and a bottom plan view of a bottom member.

DESCRIPTION OF THE PREFERRED EMBODIMENTS

With reference to the drawings, the present invention will be explained in detail hereinafter.

Figure 1:
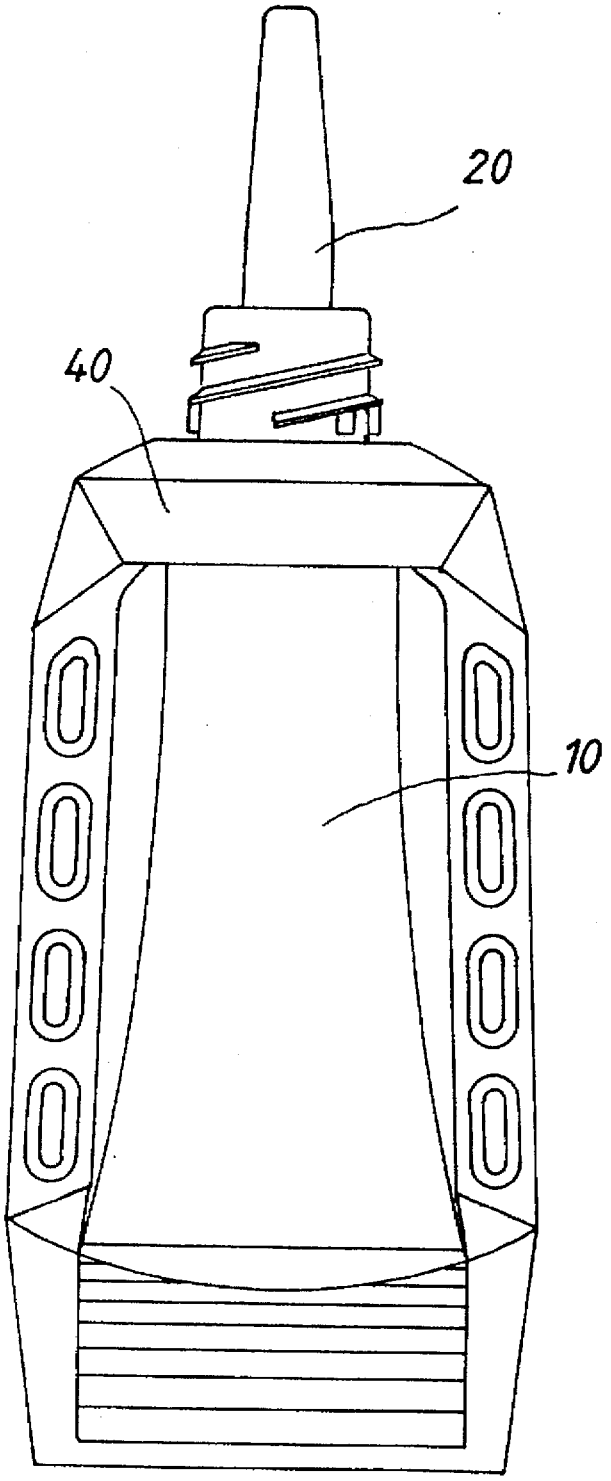
FIG. 1 is a front view to help explain one example of a discharge container with a nozzle of the present invention.

FIG. 1 is a front view to help explain one example of a discharge container with a nozzle of the present invention, in which numeral 10 designates a container body, specifically an aluminum tube and the like; numeral 20 designates a nozzle screwed to the container body 10; and numeral 40 designates a dual-shoulder type protective frame with a neck hole, which covers partially the container body 10 as shown in the figure, preferably has a bottom member, and has a structure by which the container body can be stood.

Figure 2:
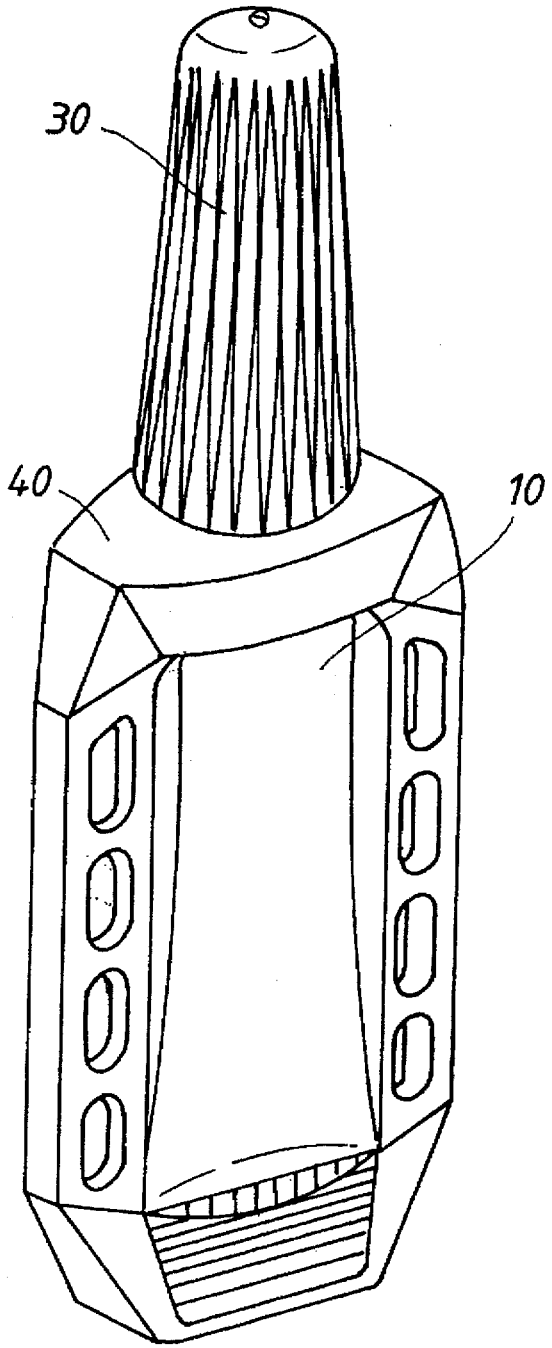
FIG. 2 is a perspective view of a state in which a cap is threadly attached.

Normally, a cap 30 is screwed to the above-mentioned nozzle 20, and FIG. 2 is a perspective view of a state in which the cap 30 is screwed.

Then, there will be sequentially explained the elements composing the present invention of the container body 10 for housing contents, the nozzle 20 screwed to the container body 10, the dual-shoulder type protective frame 40 with a neck hole and the cap 30 used as required, and the connecting relationship thereof, the modifications thereof and other aspects.

FIGS. 3 and 4 are views to help explain the dual-shoulder type protective frame 40 with a neck hole that the present invention features, in which FIG. 3-*a* is a front view; FIG. 3-*b* is a section view taken on line A—A thereof; and FIG. 3-*c* is a bottom plan view thereof. FIGS. 4-*a* and 4-*c* are plan views of the dual-shoulder type protective frame 40 with a neck hole 45; and FIG. 4-*b* is a side view thereof. In the above-mentioned views, there are mounted a bottom member, providing a structure capable of being stood.

The insertion of the container body 10 through the dual-shoulder type protective frame 40 is performed in such a manner that the mouth of the container body 10 is inserted through the neck hole 45 of the dual-shoulder type protective frame 40 as illustrated by the arrow of FIG. 3-*a*.

Figure 5:
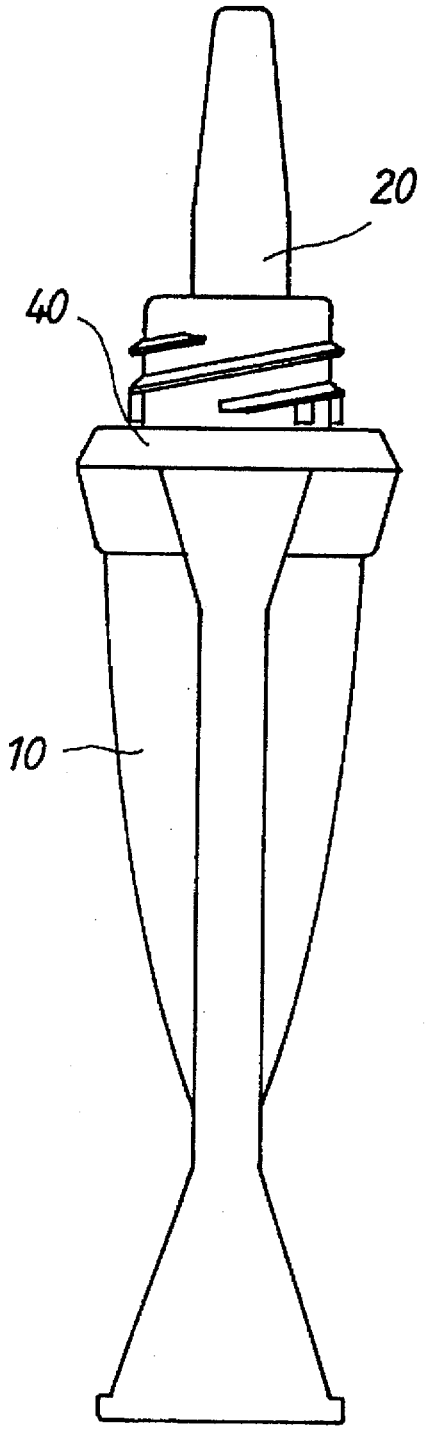
FIG. 5 is a side view where a nozzle is mounted.

FIG. 5 is a side view where the mouth of the container body 10 is inserted through the neck hole 45 of the dual-shoulder type protective frame 40, to which mouth the nozzle 20 is mounted, and as apparent from the figure, the container body 10 can be urged in both the right and left directions.

FIG. 6 is one example of a container body, showing a case of an aluminum tube. FIG. 6-*a* is a plan view: and FIG. 6-*b* is a section view taken on line B—B thereof.

Normally, as shown in the figure, the mouth of the container body 10 is provided with a male screw 12 screwed thereto, and the base end thereof is protrusively provided with ribs 11, 11'. The ribs 11, 11' have a function such that they engage with one or more notch grooves, described later, provided on the inner peripheral surface of the neck hole of the dual-shoulder type protective frame, thereby preventing a relative rotation of the container body to the dual-shoulder type protective frame. Therefore, the number of the ribs and notch grooves in this case need be only capable of preventing a relative rotation of the container body to the dual-shoulder type protective frame, and though particularly there is no limitation in the number, the number of the ribs is usually one to twenty, preferably two to ten, six ribs being shown in the figure. The number of the notch grooves is one to 140, preferably 30 to 120, 72 notch grooves being shown in FIGS. 4-*a* and 4-*c*. When the number of both the above-mentioned ribs and notch grooves is too few, the degree of freedom is reduced, while when both is too many, generally the strength is reduced, so that a proper number is selected. Generally, as shown in the above-mentioned figures, it is preferable to make the number of the ribs rather few, and make that of the notch grooves rather many.

In this manner, a relative rotation of the container body to the dual-shoulder type protective frame need to be only prevented, so that the ribs and notch grooves can also be provided reversely to the above-mentioned manner such that the notch grooves are provided in the container body, while the ribs are provided on the dual-shoulder type protective frame. Also, it is obvious that the position at which the ribs are protrusively provided is not limited to a case where the ribs are provided on the neck of the tube as shown in FIG. 6-*a*, and a modification is also possible such as the one in which, for example, the ribs are protruded on the periphery of the shoulder of the tube.

FIGS. 7 and 8 are view showing one example of the nozzle 20 screwed to the container body referred to in the present invention, in which FIG. 7-*a* is a front view; FIG. 7-*b* is a bottom plan view; FIG. 8-*a* is a plan view; and FIGS. 8-*b* and 8-*c* are section views. As shown in the figures, the end base of the nozzle 20 is provided with a male screw 21 to which the cap 30, described later, is screwed, and a lower nozzle end 22 is formed with an inner ratchet gear 24 on the inner periphery thereof. The inner ratchet gear 24 is preferably provided with a plurality of slits 25, 25' dividing the gear in the peripheral direction as shown in the figure, thereby making the rotation smooth to achieve a smooth thread attaching. For a similar purpose, the skirt portion of the lower nozzle end 22 is provided with laterally cut slits 27 parallel to the circumferential direction (which are shown in a state that four laterally cut slits are provided in FIG. 7-*b*), thereby allowing a smooth rotation and thread attaching to be achieved.

The nozzle, as shown in the section views thereof (FIGS. 8-*b* and 8-*c*), is provided with a female screw 23 corresponding to the male screw 12 of FIG. 6, and by the thread attaching, the container is integrated with the nozzle.

FIGS. 9 and 10 are views showing one example of the cap 30 screwed to the nozzle referred to in the present invention, in which FIG. 9-*a* is a front view; FIG. 9-*b* is a section view taken on line C—C thereof; FIG. 10-*a* is a schematic section view thereof; and FIG. 10-*b* is a bottom plan view. As shown in the figures, in order to close completely the above-mentioned nozzle 20, a cylindrical member 31 protruding inwardly is provided to the cap 30, the head of which cylindrical member 31 is provided with a concave hole 32 into which or from which the tip of the above-mentioned nozzle 20 is insertable or disengagable. Provided inside the cap 30 are three or more ribs 35, 35' for introducing the nozzle, whereby the cap 30 can be smoothly engaged and disengaged. Further, as shown in FIG. 10-*a*, a gas leakage peak 36 is provided on the entire peripheral surface of the inner wall of the cap 30, thereby allowing the sealing ability of the cap 30 to be enhanced, and, for example, gas leakage and the like to be prevented and thus the sealing ability of the cap 30 to be further enhanced.

Figure 13:
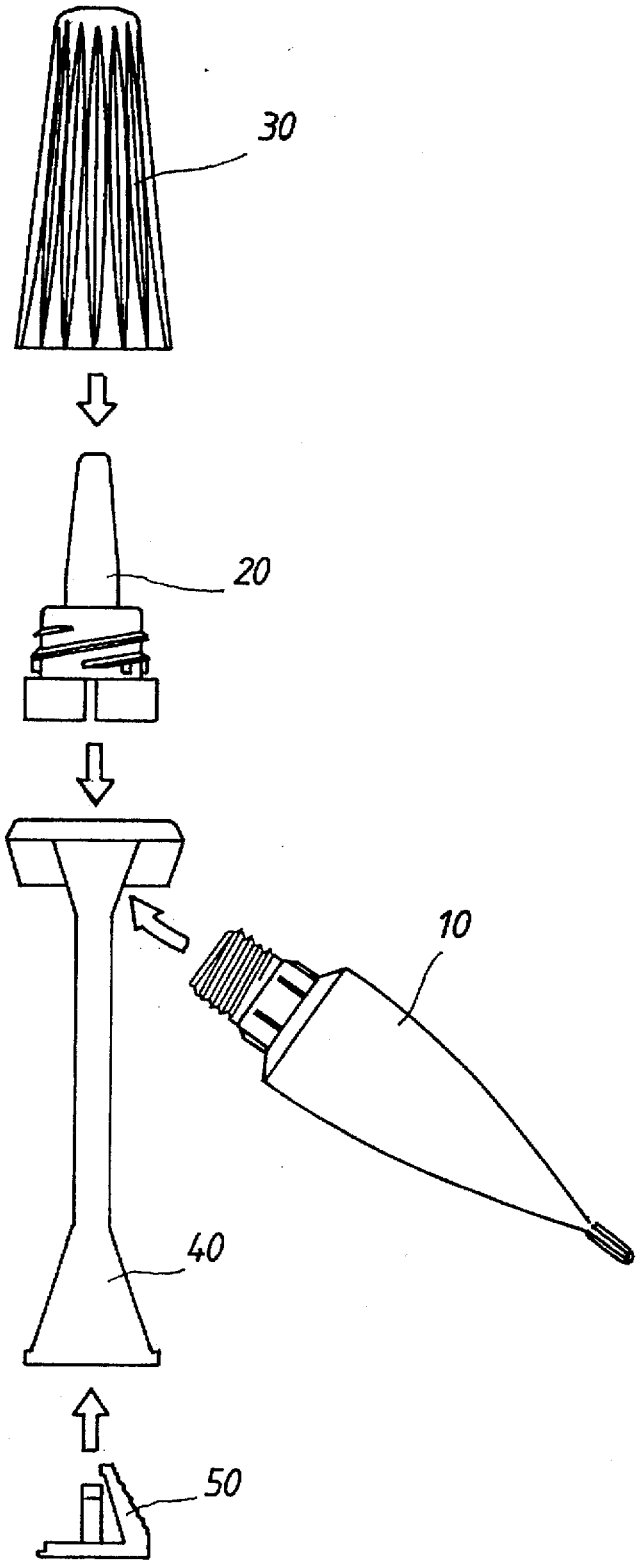
FIG. 13 is an illustrative view of an assembling procedure in manufacturing a discharge container with a nozzle of the present invention.

FIG. 13 is a view showing one example of an assembling procedure in manufacturing a discharge container with a nozzle of the present invention. As apparent from the illustrative description, the manufacture of a discharge container with a nozzle of the present invention is such that the cap 30 is screwed to the nozzle 20, while the mouth of the container body 10 is inserted through the neck hole 45 of the dual-shoulder type protective frame 40, and finally the bottom member is fitted into the frame 40, thereby providing an assembled product.

Figure 14:
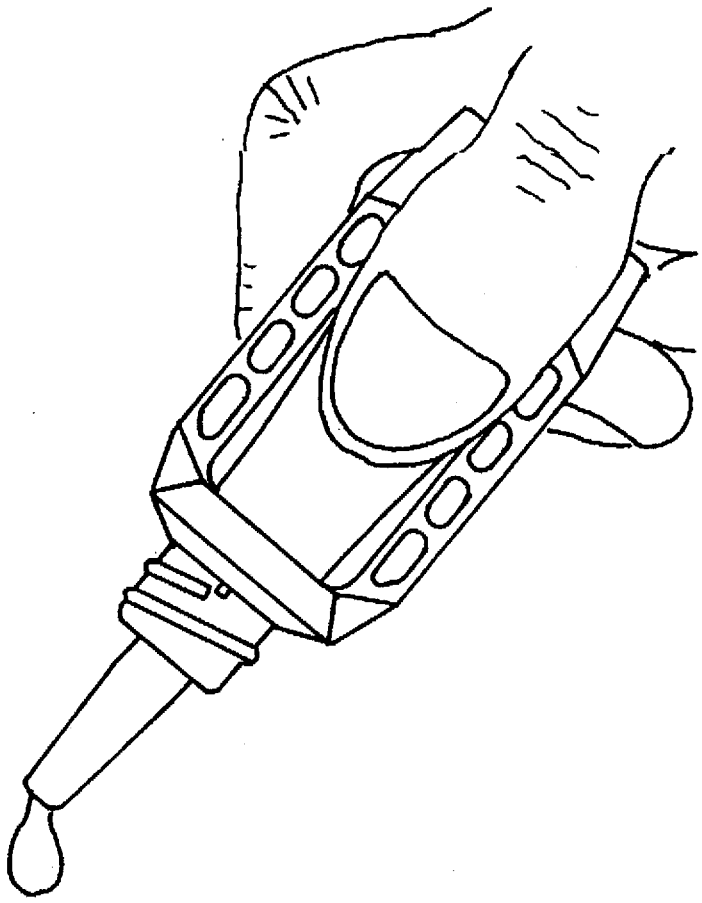
FIG. 14 is a view illustrating a discharging state.

In using a discharge container with a nozzle of the present invention, the operation of the mouth opening and urging of the container body 10 is required. This operation is performed in such a manner that when the nozzle 20 is integrated with the dual-shoulder type protective frame 40 by threadly attaching the container body 10 to the nozzle 20, the protruded portion at the lower end of the nozzle 20 breaks through a closing film on the mouth of the container body 10 to open the mouth, whereby the container body 10 and the nozzle 20 communicate with each other, and an urging causes contents to be discharged from the nozzle 20. FIG. 14 is one example showing a state of discharging.

Figure 15:
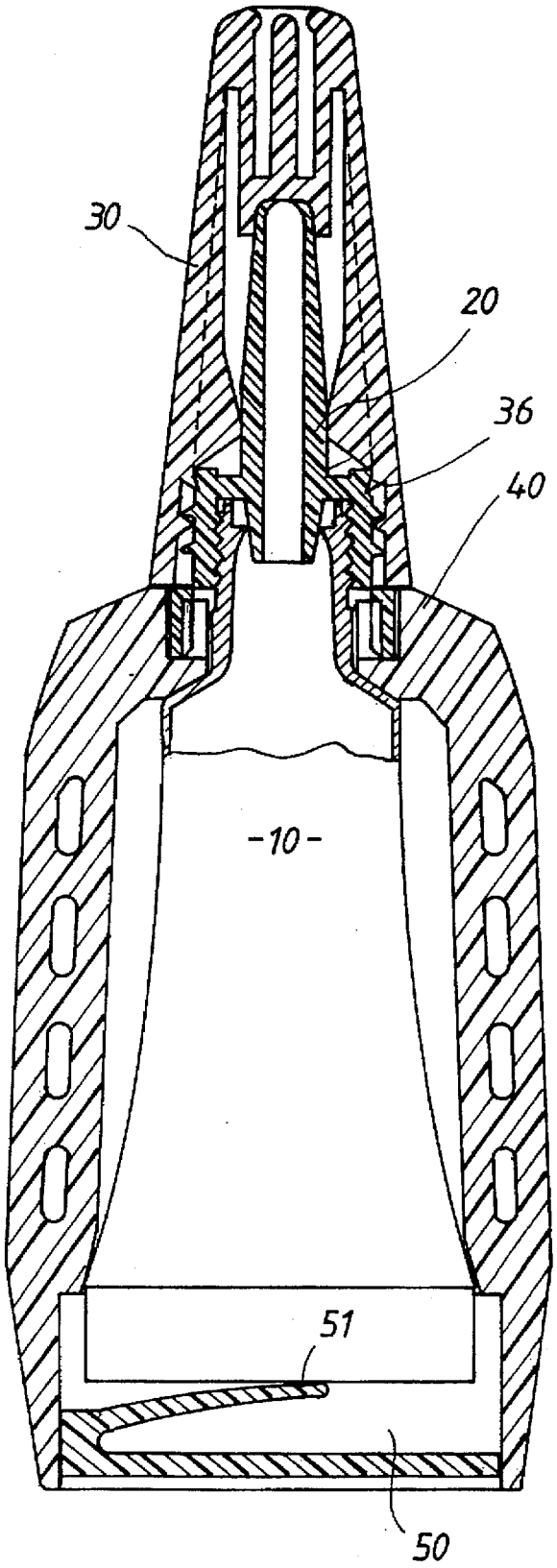
FIG. 15 is a section view of a discharge container with a nozzle and a cap of the present invention.

FIG. 15 is a section view showing the whole of a discharge container with a nozzle and a cap of the present invention, and showing a state in which the container body 10 and the nozzle 20 have communicated with each other.

Then, as shown in the above-mentioned FIGS. 3 and 4, the base end of the mouth of the container body 10 is inserted through the dual-shoulder type protective frame 40, and provided on the outer peripheral surface thereof is a boss formed with an outer ratchet gear 44 corresponding to the inner ratchet gear 24 formed on the inner periphery at the lower end of the above-mentioned nozzle 20. This provides a mechanism capable of preventing the cap 30 from being strongly and threadly tightened with a force highter than a certain value, and the nozzle 20 from being turned together with the cap 30 when threadly untightened.

Although the structure of the ratchet gear has been described above-mentioned in FIG. 4, in a case where provided on the outer peripheral surface of the neck hole 45 of the dual-shoulder type protective frame 40 is a boss formed with the outer ratchet gear 44 corresponding to the inner ratchet gear 24 formed on the inner periphery at the lower end of the above-mentioned nozzle 20, a modification may be possible in which as shown in FIG. 4-*c*, a boss formed with an inner ratchet gear 46 is provided on the inner peripheral surface outside the neck hole 45 of the dual-shoulder type protective frame 40, while as shown in FIG. 8-*c*, correspondingly thereto, an outer ratchet gear 26 formed on the outer periphery at the lower end of the nozzle 20 is provided so as to be used for a similar purpose.

A preferred embodiment of the dual-shoulder type protective frame having the neck hole that the present invention features is such that as shown in FIG. 3-*a*, the front thereof is substantially rectangular shape (formed of a line connecting sequentially points m, n, p and o in FIG. 3-*a*), and the side thereof is composed of two columns (X and Y). The reason the side is made columnar shape is that as described by the example of application in FIG. 14, the shape causes both the front and back to be opened to facilitate urging, and the reason the front view formed by the line connecting sequentially points m, n, p and o in FIG. 3-*a* is substantially rectangular shape is that when the contents in a metallic tube becomes less as the tube is actually used, the tube is deformed and finally becomes flat to widen the tube width, so that a space to accommodate the widened width is required. If such a space is not provided, the container body bumps against (becomes in contact with) the dual-shoulder type protective frame, so that it becomes difficult to discharge completely the contents from the container body. Therefore, it is obvious that a complete rectangular shape is not essential, and a space capable of housing the above-mentioned tube need to be only held. Also, it is obvious that as shown in FIG. 3-*a*, there is no trouble even when a greater importance is attached to the appearance to narrow somewhat the upper portion.

Further, a preferred embodiment of the present invention is such that as shown in FIG. 3-*b*, as for the shape of two colums (X and Y) to compose the side, the section thereof is formed in a manner to narrow as it goes inside. That is, in the figure, the distance between points g and h is made smaller than that between points e and f. This is because it is advantageous that although as urging the container body causes the contents to be discharged and thus becomes less, the thickness of the container body also becomes thin, as described above, the section is formed in a manner to narrow as it goes inside in order to squeeze completely the contents out.

Also, FIG. 3-*c* is a bottom plan view of the dual-shoulder type protective frame, and the bottom member is part of the dual-shoulder type protective frame in the present invention and has a function as an outer reinforcing casing supporting the container body. Therefore, although the shape and structure thereof are not particularly limited, various methods are considered for industrially producing the discharge container with a nozzle and a cap of the present invention.

Although the bottom plan view of the above-mentioned FIG. 3-*c* is in a state in which part of the bottom member is removed, and the member as it is can be stood, usually the bottom member is reinforced to produce a product. Alternatively, the bottom member is composed of one or more parts, which parts are sequentially assembled in a conveyor line process to produce a product.

FIGS. 11 and 12 are views showing one example of parts of the bottom member.

In the figures, FIG. 11-*a* is a plan view of parts of the bottom member; FIG. 11-*b* is a front view thereof; FIG. 12-*a* is a front view as viewed in the direction opposite to FIG. 11-*b*; FIG. 12-*b* is a section view taken on line D—D thereof; FIG. 12-*c* is a section view taken on line E—E thereof; and FIG. 12*d* is a bottom plan view thereof.

As shown in FIG. 13, it is preferable as an industrial manufacturing method that after the container body is inserted through, the parts of the bottom member are fitted into to achieve an integration.

In the discharge container with a nozzle of the present invention, a preferred embodiment is such that a bottom member 50 of the dual-shoulder type protective frame is provided with a mechanism for pushing up the container body 10 at all times. The mechanism can be operated by the resilience of a resin piece buried in the bottom member 50 of the dual-shoulder type protective frame. FIG. 11-*b* shows a case where the resilience of a resin piece is utilized, in which numeral 51 designates a resin piece buried in the bottom member. Instead of the resin piece 51, the mechanism may be also operated by the resilience of a spring buried in the bottom member.

The mechanism for pushing up the container body at all times is required in order to exhibit effectively the function of the discharge container with a nozzle of the present invention, and to make it easy to use safely the container.

Then, with respect to the material for the discharge container with a nozzle and a cap of the present invention, as described previously, the container employs a metallic tube, preferably an aluminum tube.

The material is a for the nozzle and cap used plastic material, which preferably includes polystyrene resin, polyolefin such as polyethylene, polypropylene, other polyester resin, polyamide resin, fluoroplastic and vinyl chloride resin.

With respect to the material for the dual-shoulder type protective frame having the neck hole, other than the above-mentioned resins, a relatively hard, synthetic resin is preferably used such as ABS resin, vinyl chloride resin, polycarbonate resin, polyacetal resin, styrene resin, urethane resin and hard rubber etc. As the other material, there can also be used metallic group such as aluminum, steel, brass and copper, and wood group. These materials are used so that it has the function of the protective frame when the container body is opened or closed, and also the function as the outer casing.

Although the discharge container with a nozzle or the discharge container with a nozzle and a cap of the present invention is applied preferably and particularly to a relatively high viscosity liquid such as jelly like one, the present invention is not only used for a high viscosity liquid, but also for a low viscosity liquid. In the latter case, in order to enhance a suck mechanism (the so-called squeezability) for preventing a liquid run from the nozzle during service, a cylindrical elastic material or an elastic tube with a flexibility may be wrapped or fittingly attached on the outer periphery of a container body, for example, a tube body of a metal such as aluminum; and an elastic material may be housed in the container body of metallic tube, and the resilience (elasticity) thereof may be also utilized to enhance the squeezability for preventing a liquid run, which are one of preferred embodiments of the present invention.

The container according to the present invention is a highly safe and easy-to-use one which can house a relatively high viscosity liquid such as jelly like and grease like ones, be stood, discharge the contents smoothly until before the last service, provide no liquid run and leakage, and discharge the contents completely until before the last service.

Particularly, the container of the present invention is very excellent in safety and operability such that the container is opened or closed through the protective frame without touching directly the container body, so that the tube when used is not deformed or broken until before the last service. Further, the discharge container with a nozzle and a cap of the present invention is very excellent such that it can be not only used for a high viscosity liquid, but also sufficiently for a low viscosity liquid by being modified somewhat as required.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A discharge container with a nozzle comprising:

a container body for housing contents;

a nozzle screwed to said container body;

a dual-shoulder protective frame having a neck hole and a bottom member; and a mechanism for pushing up the container body at all times provided on the bottom member of the dual-shoulder protective frame, wherein a base end of a mouth of said container body is inserted through the neck hole of said dual-shoulder protective frame, and said container body is screwed to the nozzle, thereby forming one united structure.

2. The discharge container with a nozzle as set forth in claim 1, wherein the bottom member at least partially covers a lower end of the container body, thereby providing structure by which the container can be stood up.

3. The discharge container with a nozzle as set forth in claim 1, wherein at least one notch groove is provided on an inner peripheral surface of the neck hole of the dual-shoulder protective frame, while at least one rib engaging with said notch groove is provided on the base end of the mouth of the container body, thereby providing a structure for preventing relative rotation of the container body to the dual-shoulder protective frame.

4. The discharge container with a nozzle as set forth in claim 1, wherein the dual-shoulder protective frame has a columnar shape at the sides thereof.

5. The discharge container with a nozzle as set forth in claim 4, wherein columnar members, which compose the side of the dual-shoulder protective frame, have a section thereof formed in a manner to narrow progressing inwardly toward the container.

6. The discharge container with a nozzle as set forth in claim 1, wherein the bottom member of the dual-shoulder protective frame is formed by one or more parts.

7. The discharge container with a nozzle as set forth in claim 1, wherein the whole shape of the dual-shoulder protective frame has a structure capable of being stood up and is substantially rectangular in the front view thereof.

8. The discharge container with a nozzle as set forth in claim 1, wherein the mechanism for pushing up the container body at all times is operated by resilience of a resin piece buried in the bottom member of the dual-shoulder protective frame.

9. The discharge container with a nozzle as set forth in claim 1, wherein the material forming the dual-shoulder protective frame is a hard synthetic resin.

10. The discharge container with a nozzle as set forth in claim 1, wherein the container is provided with a cap screwed to the nozzle.

11. The discharge container with a nozzle as set forth in claim 1, wherein the container body for housing contents is made of aluminum.

12. The discharge container with a nozzle as set forth in claim 1, wherein at least one rib is provided on an inner peripheral surface of the neck hole of the dual-shoulder protective frame, while at least one groove engaging with said rib is provided on the base end of the mouth of the container body, thereby providing a structure for preventing relative rotation of the container body to the dual-shoulder protective frame.

13. A discharge container with a nozzle comprising:

a container body for housing contents;

a nozzle screwed to said container body; and a dual-shoulder protective frame having a neck hole, wherein a base end of a mouth of said container body is inserted through the neck hole of said dual-shoulder protective frame, and said container body is screwed to the nozzle, thereby forming one united structure, and wherein a boss having an outer ratchet gear corresponding to an inner ratchet gear formed on an inner periphery at a lower end of said nozzle is provided on an outer peripheral surface of the neck hole of the dual-shoulder protective frame.

14. The discharge container with a nozzle as set forth in claim 13, wherein both of the members formed with an inner ratchet gear or an outer ratchet gear are formed with slits dividing said members in the peripheral direction.

15. The discharge container with a nozzle as set forth in claim 13, wherein one of the members formed with an inner ratchet gear or an outer ratchet gear is formed with slits dividing said members in the peripheral direction.

16. A discharge container with a nozzle comprising:

a container body for housing contents;

a nozzle screwed to said container body; and a dual-shoulder protective frame having a neck hole, wherein a base end of a mouth of said container body is inserted through the neck hole of said dual-shoulder protective frame, and said container body is screwed to the nozzle, thereby forming one united structure, and wherein a boss having an inner ratchet gear corresponding to an outer ratchet gear formed on an outer periphery at a lower end of said nozzle is provided on an inner peripheral surface outside of the neck hole of the dual-shoulder protective frame.

17. The discharge container with a nozzle as set forth in claim 16, wherein both of the members formed with an inner ratchet gear or an outer ratchet gear are formed with slits dividing said members in the peripheral direction.

18. The discharge container with a nozzle as set forth in claim 16, wherein one of the members formed with an inner ratchet gear or an outer ratchet gear is formed with slits dividing said members in the peripheral direction.

* * * * *